US010077961B2

(12) United States Patent
Carr

(10) Patent No.: US 10,077,961 B2
(45) Date of Patent: Sep. 18, 2018

(54) STRIKER SYSTEM FOR FIREARMS

(71) Applicant: STI Firearms, LLC, Georgetown, TX (US)

(72) Inventor: Jesse Carr, Fremont, NH (US)

(73) Assignee: STI Firearms, LLC, Georgetown, TX (US)

( * ) Notice: Subject to any disclaimer, the term of this patent is extended or adjusted under 35 U.S.C. 154(b) by 0 days.

(21) Appl. No.: 15/397,066

(22) Filed: Jan. 3, 2017

(65) Prior Publication Data

US 2018/0187994 A1 Jul. 5, 2018

(51) Int. Cl.

| | |
|---|---|
| ***F41A 19/30*** | (2006.01) |
| ***F41A 19/31*** | (2006.01) |
| ***F41A 19/34*** | (2006.01) |

(52) U.S. Cl.

CPC ..... *F41A 19/30* (2013.01); *F41A 19/31* (2013.01); *F41A 19/34* (2013.01)

(58) Field of Classification Search

CPC ..... F41A 19/30; F41A 19/31; F41A 19/34; F41A 19/36; F41A 19/37; F41A 19/39

USPC ..... 42/69.02, 69.03

See application file for complete search history.

(56) References Cited

U.S. PATENT DOCUMENTS

| | | | | | |
|---|---|---|---|---|---|
| 4,679,487 | A * | 7/1987 | Houseman | F41A 19/33 | 42/75.03 |
| 5,050,480 | A * | 9/1991 | Knight, Jr. | F41A 5/06 | 42/7 |
| 5,086,578 | A * | 2/1992 | Lishness | F41A 19/32 | 42/69.02 |
| 5,701,698 | A * | 12/1997 | Wesp | F41A 19/35 | 42/69.02 |
| 6,266,909 | B1 * | 7/2001 | Fuchs | F41A 19/31 | 42/70.05 |
| 8,720,096 | B2 | 5/2014 | Siddle | | |
| 2016/0047613 | A1 | 2/2016 | Hudson, III et al. | | |
| 2016/0084600 | A1 | 3/2016 | Siddle | | |
| 2017/0184366 | A1 * | 6/2017 | Zajk | F41A 17/56 | |

* cited by examiner

*Primary Examiner* — Bret Hayes
(74) *Attorney, Agent, or Firm* — Fish & Richardson P.C.

(57) ABSTRACT

A firearm firing system that includes a striker assembly and a fire control assembly. The striker assembly includes a striker housing, a striker disposed within the striker housing, and a sear bar coupled to the striker housing. The sear bar is configured to engage a sear engagement surface of the striker through an opening in the striker housing. The fire control assembly includes a cocking block and a transfer lever. The cocking block is configured to engage with and pivot the sear bar. The transfer lever is configured to transfer force from a trigger to the cocking block.

20 Claims, 10 Drawing Sheets

STRIKER SYSTEM FOR FIREARMS

TECHNICAL FIELD

This invention relates to striker firing systems for firearms.

BACKGROUND

Firearm firing systems are generally either hammer based or striker based. In a hammer fired firearm, the trigger releases a hammer which impacts a firing pin. The firing pin, in turn, impacts the cartridge primer to fire the weapon. In a striker fired firearm, the trigger releases an internal striker with an integral firing pin. The firing pin portion of the striker impacts the cartridge primmer to fire the weapon. While striker fired firearms have many advantages over hammer fired firearms, a common disadvantage is a less "crisp" or "mushy" trigger feel compared to hammer fired counterparts.

SUMMARY

In general, innovative aspects of the subject matter described in this specification can be embodied in methods that include a firearm firing system that includes a striker assembly and a fire control assembly. The striker assembly includes a striker housing, a striker disposed within the striker housing, and a sear bar coupled to the striker housing. The sear bar is configured to engage a sear engagement surface of the striker through an opening in the striker housing. The fire control assembly includes a cocking block and a transfer lever. The cocking block is configured to engage with and pivot the sear bar. The transfer lever is configured to transfer force from a trigger to the cocking block. This and other implementations can each optionally include one or more of the following features.

In some implementations, the striker housing is configured to be installed within a firearm slide.

In some implementations, the fire control assembly is configured to be installed within a firearm frame.

In some implementations, the sear bar includes a sear at a first end of the sear bar, the sear being configured to engage the sear engagement surface of the striker, where the cocking block engages the sear bar at a second end opposite the first end.

In some implementations, the fire control assembly includes a fire control housing with the cocking block and the transfer lever disposed therein. In some implementations, the cocking block includes posts that engage with corresponding channels in inside surfaces of the fire control housing such that cocking block is free to pivot and slide fore and aft within the channels.

In some implementations, the sear bar includes a sear at a first end of the sear bar, the sear being configured to engage the sear engagement surface of the striker, where the cocking block engages the sear bar at a second end of the sear bar, opposite the first end. The transfer lever is configured to be pivotally coupled inside a firearm frame such that a force applied from a trigger of the firearm to a first end of the transfer lever causes the transfer lever to pivot such that a second, opposite end of the transfer lever engages the cocking block, thereby, pivoting the cocking block and causing the cocking block to pivot the second end of the sear bar upwards and the first end of the sear bar downwards to disengage the sear from the striker.

In some implementations, the cocking block includes a cocking tab that is configured to engage a back surface of the striker housing to retain the striker housing stationary during a rearward movement of a firearm slide, thereby, cocking the striker. In some implementations, the cocking tab is integral to the cocking block. In some implementations, the cocking tab is housed within a channel in the cocking block and configured to slide within the channel.

In some implementations, the cocking block includes a lug at an end of the cocking block opposite the cocking tab, the lug being configured to engage a cam surface of a firearm slide.

In another general aspect the subject matter described in this specification can be embodied in a striker assembly that includes a striker housing, a striker disposed within the striker housing, and a sear bar coupled to the striker housing. The sear bar is configured to engage a sear engagement surface of the striker through an opening in the striker housing. This and other implementations can each optionally include one or more of the following features.

Some implementations include a spring disposed between the striker housing and a rear surface of the striker.

In some implementations, the sear bar includes a sear at a first end of the sear bar and a lip at a second end of the sear bar, opposite the first end.

Some implementations include a spring disposed between the striker housing and a rear surface of the striker, where the lip of the sear bar is in contact with an end of the spring such that the spring exerts a force on the sear bar which biases the sear of the sear bar to engage with the sear engagement surface of the striker.

In some implementations, the striker housing is configured to be installed within a firearm slide.

In some implementations, the sear bar includes a sear at a first end of the sear bar, the sear being configured to engage the sear engagement surface of the striker such that when a force is applied to a second end of the sear bar, opposite the first end, the sear bar pivots to disengage from the sear engagement surface of the striker.

In some implementations, the striker includes a first portion having a first diameter and a second portion having a second diameter larger than the first diameter, where the first portion of the striker is disposed within the striker housing, and where the second diameter is larger than an inside dimension of the striker housing.

In another general aspect the subject matter described in this specification can be embodied in a striker assembly that includes a firearm that includes a frame, a slide installed on the frame, a striker housing installed within the slide, a striker disposed within the striker housing, a sear bar coupled to the striker housing, and a fire control assembly installed within the frame. The fire control assembly includes a cocking block and a transfer lever. The cocking block is configured to engage with and pivot the sear bar. The transfer lever is configured to transfer force from a trigger to the cocking block to pivot the sear bar and, thereby, disengage the sear bar from a sear engagement surface of the striker. This and other implementations can each optionally include one or more of the following features.

In some implementations, the sear bar includes a sear at a first end of the sear bar. The sear is configured to engage the sear engagement surface of the striker. The cocking block engages the sear bar at a second end of the sear bar, opposite the first end. And, the transfer lever is pivotally coupled inside the frame such that a force applied from a trigger of the firearm to a first end of the transfer lever causes the transfer lever to pivot such that a second, opposite end of the transfer lever engages the cocking block, thereby, pivoting the cocking block and causing the cocking block to pivot the second end of the sear bar upwards and the first end of the sear bar downwards to disengage the sear from the striker.

The concepts described herein may provide several advantages. For example, implementations provide a striker fired firearm with a straight-pull "1911 style" trigger instead of a hinged-style trigger. Implementations of the invention may improve trigger feel (e.g., "crispness") for a striker fired firearm. Implementations may improve trigger controllability for striker fired firearms. Implementations may improve the practical accuracy and precision of striker fired firearms.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
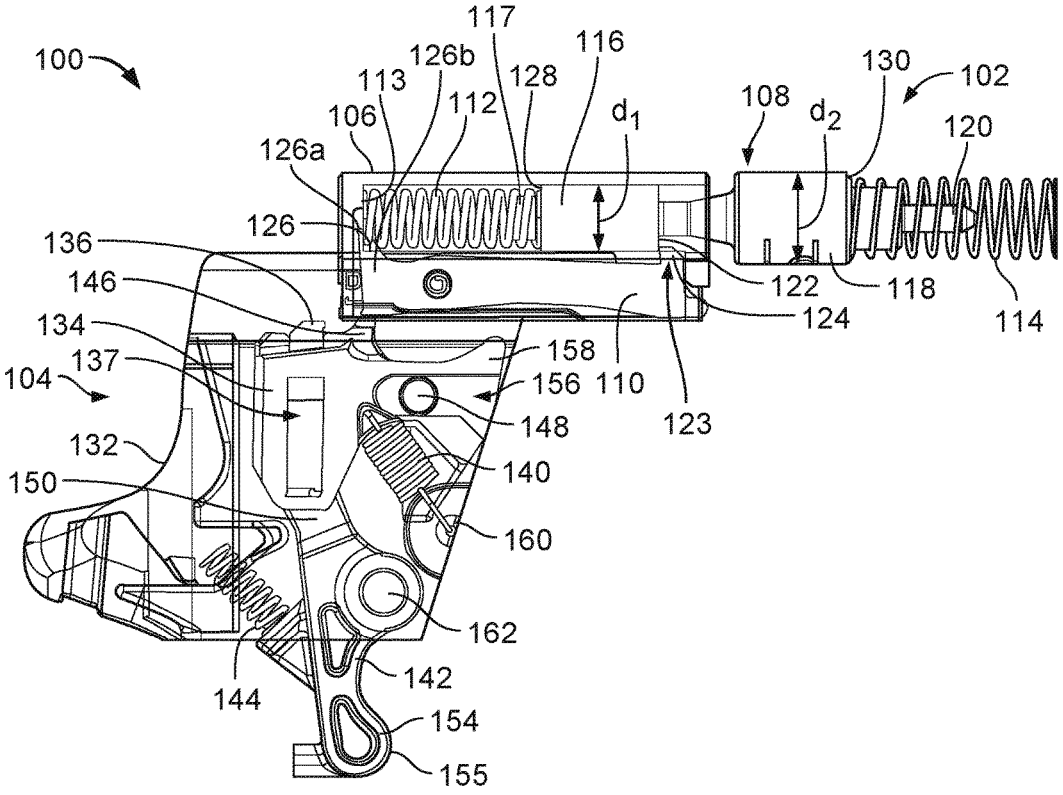
FIG. 1 depicts a right-side internal diagram of an example striker firing system in accordance with implementations of the present disclosure.

Implementations of the present disclosure are generally directed to a striker firing system for a firearm. The striker firing system includes a striker assembly that is configured to be installed within a fire arm slide and a fire control assembly that is configured to be installed within a firearm frame. The striker assembly includes sear bar coupled to a striker housing. The sear bar includes a sear surface that engages with a striker disposed within the housing. The fire control assembly includes a transfer lever and a cocking block which act together to disengage the sear from the striker to discharge a firearm. The cocking block further operates to cock the striker within the striker housing by the rearward movement of the firearm slide. In some implementations, the striker firing system of the present disclosure are particularly adapted for use with a straight-pull trigger, such as those common in 1911 style firearms.

For simplicity, implementations of the present disclosure will be described in reference to a semiautomatic handgun, however, one skilled in the art would appreciate that one or more of the implementations described below may be incorporated into other firearms designs.

As used herein, the term "semiautomatic firearm" refers to a firearm which automatically extracts a spent cartridge casing and chambers a new round after each shot. The semiautomatic firearm uses a portion of the energy from a firing round to extract a spent cartridge casing from the fired round, cock the firearm, and chamber a new round with each pull of the trigger, but requires a separate pull of the trigger to discharge the new round.

As used herein, the term "non-semiautomatic firearm" refers to a firearm which requires a user to manually manipulate some mechanism of the firearm to chamber a new round after each shot.

As used herein, the term "automatic firearm" refers to a firearm which automatically extracts a spent cartridge casing, chambers a new round after each shot, and fires the new round in a repeating fashion with a single pull of the trigger. In an automatic firearm, this process repeats until the trigger is released or all of the ammunition in the firearm is expended.

As used herein, the terms "orthogonal" or "substantially orthogonal" refer to a relation between two elements (e.g., lines, axes, planes, surfaces, or components) that forms a ninety degree (perpendicular) angle within acceptable engineering, machining, or measurement tolerances. For example, two surfaces can be considered orthogonal to each other if the angle between the surfaces is within an acceptable tolerance of ninety degrees (e.g., ±1-2 degrees).

As used herein, the terms "aligned," "substantially aligned," "parallel," or "substantially parallel" refer to a relation between two elements (e.g., lines, axes, planes, surfaces, or components) as being oriented generally along the same direction within acceptable engineering, machining, drawing measurement, or part size tolerances such that the elements do not intersect or intersect at a minimal angle. For example, two surfaces can be considered aligned with each other if surfaces extend along the same general direction of a device.

As used herein, the term "recoil forces" refers forces exerted on various components of a firearm (e.g., breech face, slide, frame, recoil spring) which balance the forward momentum of a projectile being discarded from the firearm. Recoil forces are generally experienced directly at the breach face and transmitted through the breach face to other components of the firearm.

As used herein, terms describing relative directions or orientations (e.g., front, back/rear, top/upper, bottom/lower, left/right) of various elements are used in reference to the perspective of a user holding a firearm. Thus, for example, the front edge or surface of a component refers to that edge or surface of the component that is nearest or facing the muzzle of the firearm when the component is properly installed in the firearm. Similarly, for example, the back edge or surface of a component refers to that edge or surface of the component that is farthest from or facing away from the muzzle of the firearm when the component is properly installed in the firearm. Likewise, for example, the top/upper edge or surface of a component refers to that edge or surface of the component that is nearest or facing the top of the firearm when the component is properly installed in the firearm and the firearm is held in a normal firing position.

Furthermore, for example, the bottom/lower edge or surface of a component refers to that edge or surface of the component that is nearest or facing the bottom of the firearm when the component is properly installed in the firearm and the firearm is held in a normal firing position. Finally, for example, the right/left edge or surface of a component refers to that edge or surface of the component that is nearest or facing the right/left side of the firearm from the perspective of a user when the component is properly installed in the firearm and the firearm is held in a normal firing position.

Figure 2:
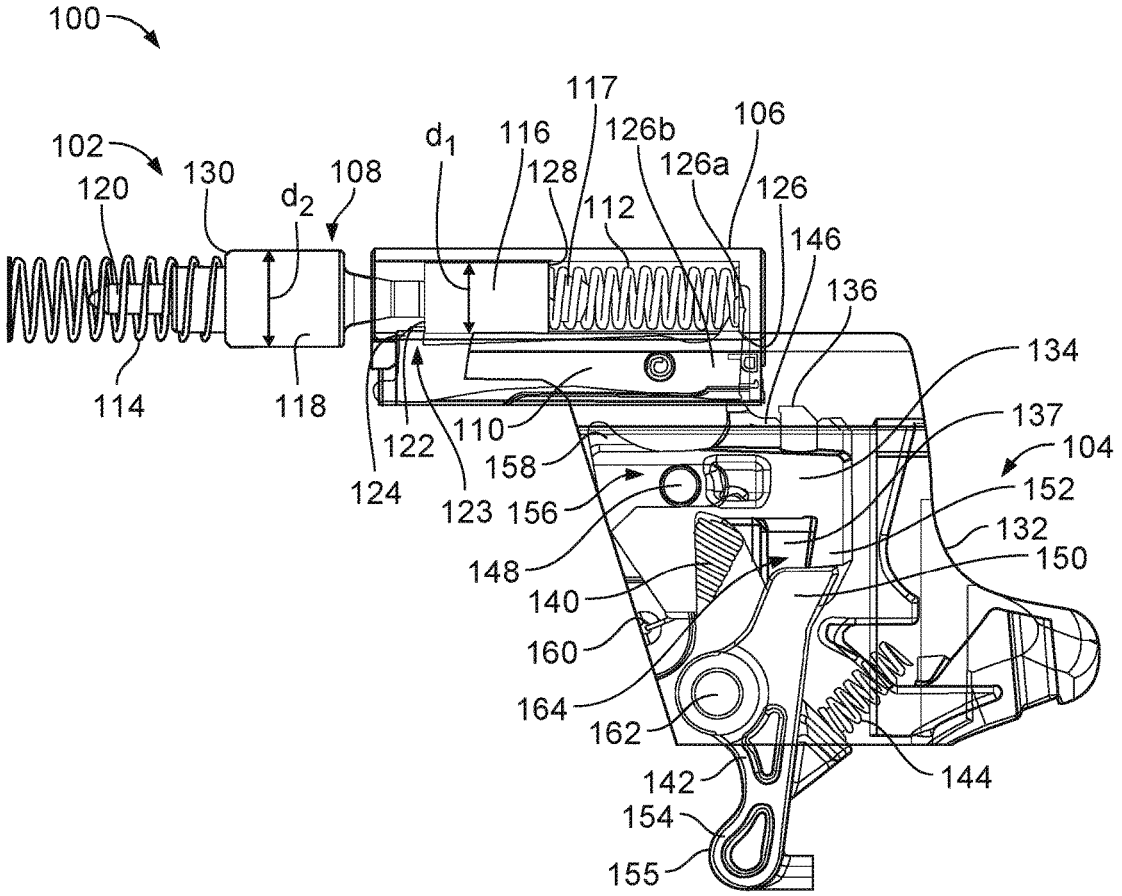
FIG. 2 depicts a left-side internal diagram of the example striker firing system of FIG. 1.
Figure 3:
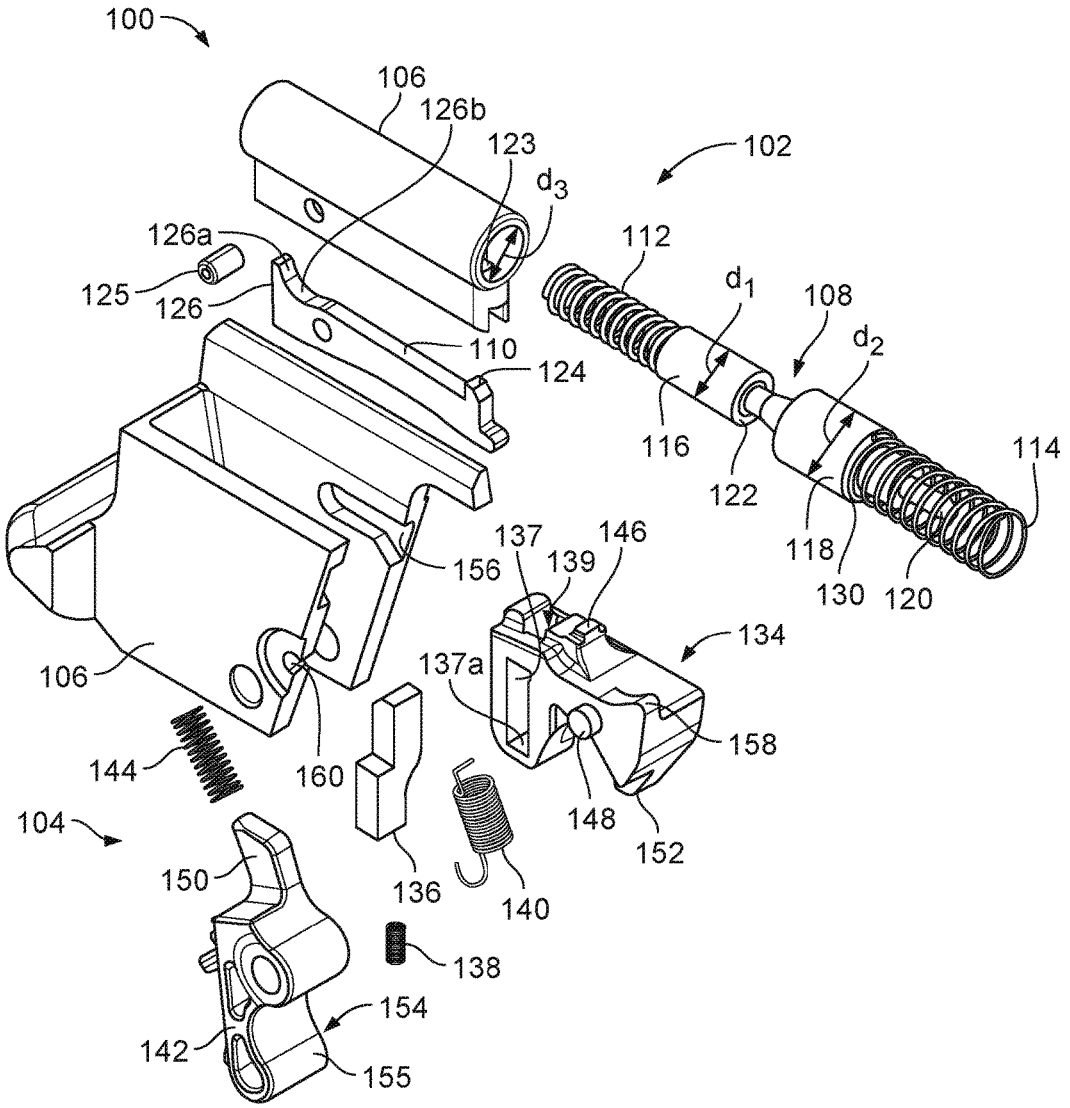
FIG. 3 depicts an exploded diagram of the example striker firing system of FIG. 1.
Figure 4:
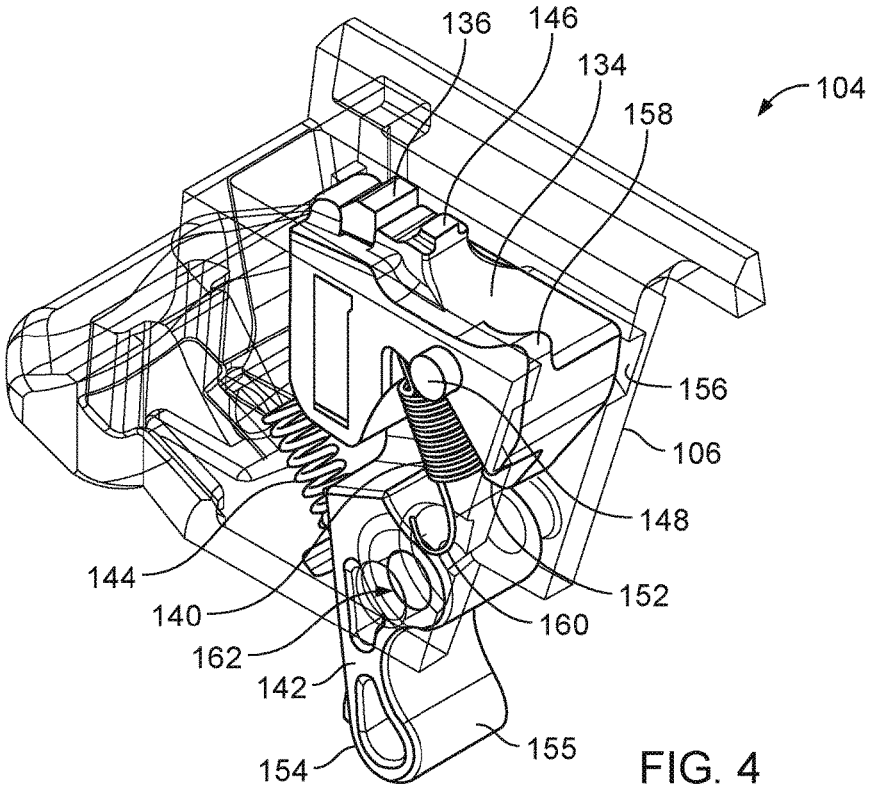
FIG. 4 depicts a perspective view of the example fire control assembly of FIGS. 1-3.
Figure 5:
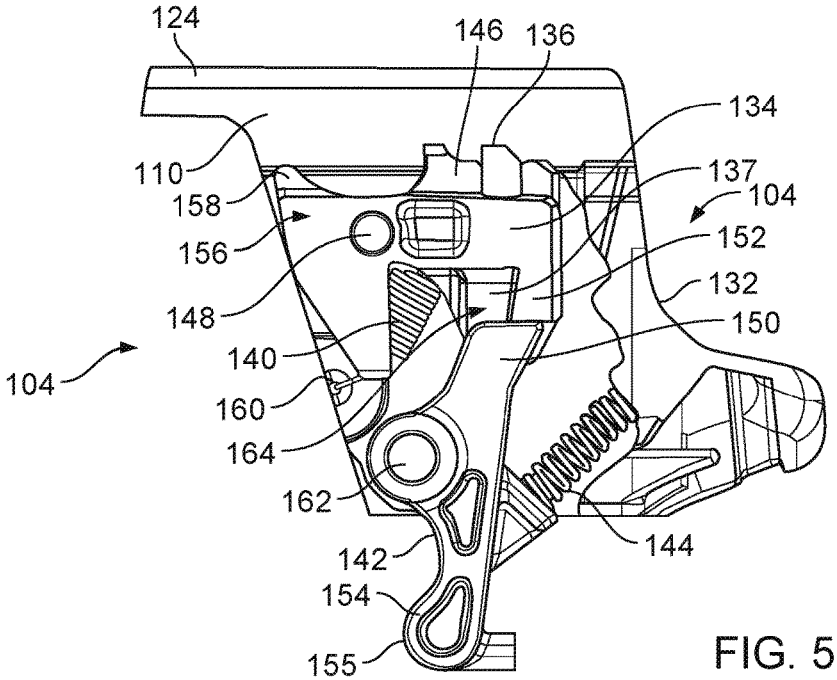
FIG. 5 depicts left-side internal diagram of the example fire control assembly of FIGS. 1-3.

FIGS. 1-3 include several drawings illustrating a representative striker firing system 100 for a firearm. FIG. 1 depicts a right-side internal diagram of striker firing system 100; FIG. 2 depicts a left-side internal diagram of striker firing system 100; and FIG. 3 depicts an exploded diagram of striker firing system 100. Firing system 100 includes a striker assembly 102 and a fire control assembly 104. Striker assembly 102 is configured to be installed in a firearm slide and fire control assembly 104 is configured to be installed in a firearm frame, as described in more detail below in reference to FIG. 6.

Striker assembly 102 includes a striker housing 106, a striker 108, and a sear bar 110. Striker 108 is disposed within the striker housing 106. Striker 108 has a rod-like shape. In some implementations, as shown, striker 106 has two portions 116 and 118 having differing diameters ($d_1$ and $d_2$). Portion 116 has a smaller diameter ($d_1$) than portion 118. Portion 16 is sized to fit within striker housing 106. Whereas, the diameter of portion 118 is slightly larger than the inside diameter ($d_3$ shown in FIG. 3) of the striker housing 106. Portion 118 can be sized to be flush with the outer diameter of the striker housing 106. The firing pin 120 extends from the front surface of portion 118.

A striker spring 112 is disposed between the rear inside surface 113 of the striker housing 106 and portion 116 of striker 108. Portion 116 provides a surface 128 on the striker 108 for the striker spring 112 to exert a force to push the striker 108 towards a cartridge primer and cause the firing pin 120 to impact the primer and discharge the cartridge. The front surface of portion 116 forms a sear engagement surface 122 for the sear bar 110. A lug 117 may extend from the rear surface of portion 116 to aid in aligning the striker spring 112 with the striker 108. With the striker assembly assembled, the coils of striker spring 112 surround lug 117.

Figure 6:
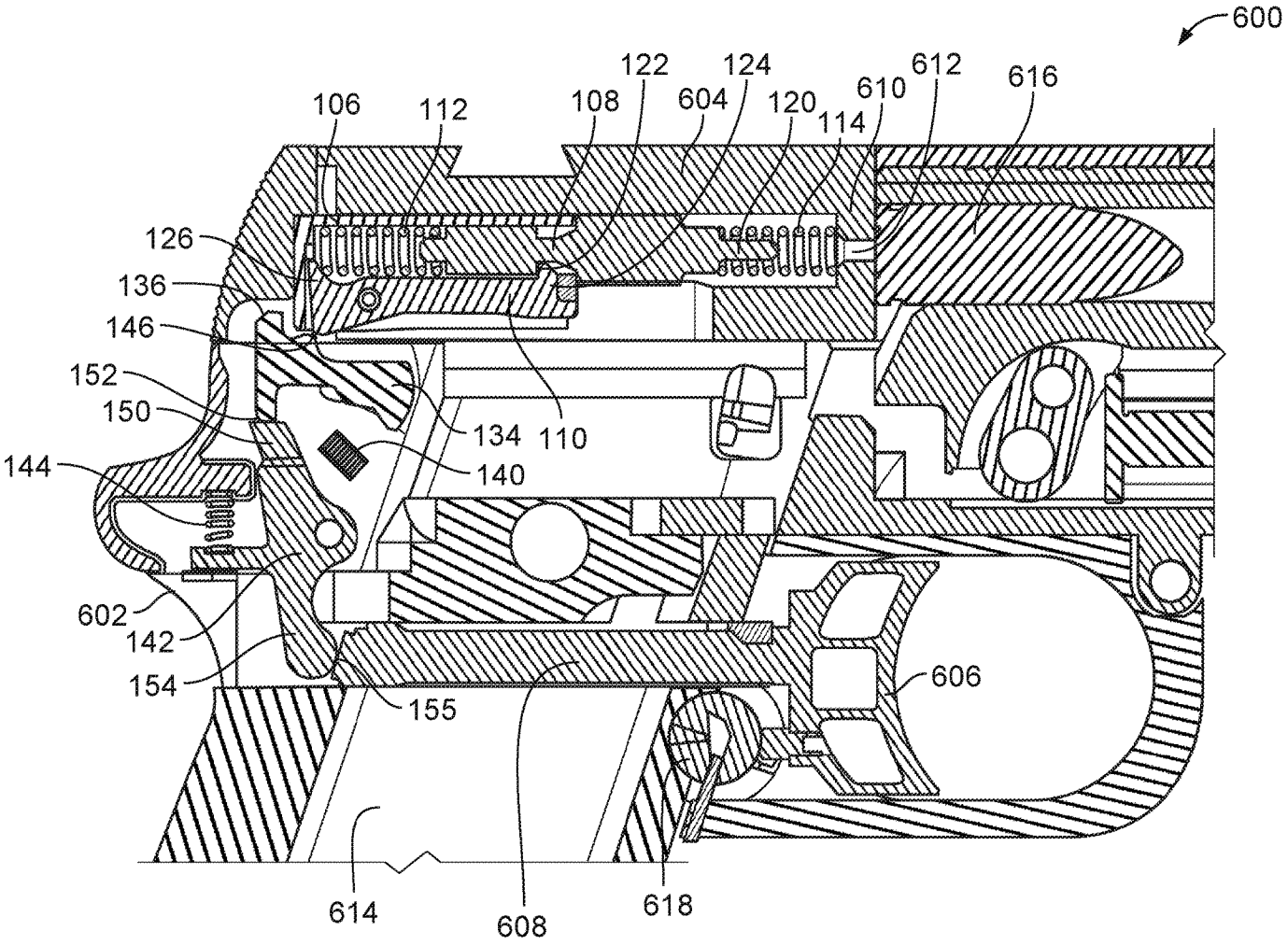
FIGS. 6-9 depict a series of internal diagrams of a firearm illustrating the operation of the example striker firing system.

A reset spring 114 is disposed between portion 118 of the striker 108 and an inner surface of a firearm slide (shown in FIG. 6). With the striker assembly assembled, the coils of reset spring 114 surround the firing pin 120. As will be described in more detail with reference to FIGS. 6-9, the reset spring resets the striker assembly 102 within the firearm slide after the striker 108 is cocked, e.g., during recoil or manual manipulation of the slide. Portion 118 provides a surface 130 on the striker 108 for the reset spring 114 to exert a force to reset the position of striker assembly 102 within the slide after cocking the striker 108.

Sear bar 110 is coupled to the striker housing 106. Sear bar 110 can be pivotally coupled to the underside of striker housing 106 as illustrated in the figures. Sear bar 110 has a sear 124 at one end. Sear 124 extends through an opening 123 in striker housing 106 to engage the sear engagement surface 122 of striker 108. When engaged with sear engagement surface 122, sear 124 holds the striker 108 in a cocked position within the striker housing 106. In the cocked position, striker spring 112 is compressed against the inner surface 113 of striker housing 106. Sear bar 110 can be coupled to the striker housing 106 by coupling device 125, e.g., a pin, roll pin, spring pin, screw, or another appropriate coupling device. Sear bar 110 is pivotally coupled to striker housing 106 so that sear 124 at the forward end of sear bar 110 is moveable to engage and disengage with the sear engagement surface 122 of striker 108.

Sear bar 110 can include a lip 126 extending from sear bar 110 at the rearward end of the sear bar 110. Lip 126 extends through the bottom of striker housing 106 and engages with the end of striker spring 112 that is in contact with the inner surface 113 of striker housing 106. Lip 126 can be shaped to prevent the sear bar 110 from perching on the striker spring 112. In some implementations, the shape of lip 126 can use pressure exerted by striker spring 112 to bias the sear bar 110 to pivot sear 124 into engagement with striker 108. For example, lip 126 can be curved with an upper portion **126*a* being narrower than a lower portion 126*b*. The curved shape directs the force applied by the striker spring 112 to lip 126 downwards. The downward directed force biases sear bar 110 to pivot downward at the rearward end and upward at the forward (or sear 124 end) of the sear bar 110. Thus, absent another force at its reward end, sear bar 110 tends to pivot sear 124 into engagement with sear engagement surface 122 of striker 108. In other words, striker spring 112 biases sear bar 110 into a cocked position. Moreover, as striker spring 112 is compressed during cocking the force of striker spring 112 on lip 126 increases, thereby, helping to retain striker 108 in a cocked position. This feature may aid in preventing an inadvertent release of striker 108** and premature firing of the firearm.

Referring to FIGS. 1-5, fire control assembly 104 is configured to be installed in a firearm frame or an assembly housing. For example, implementations installed in an assembly housing can be configured as a drop-in fire control assembly to be installed in a firearm frame. For illustrative purposes, element 132 will be referred to as an assembly housing, however, element 132 is also representative of a section of a firearm frame 602 of FIG. 6 in which the components of fire control assembly 104 are installed.

Fire control assembly 104 includes cocking block 134, cocking tab 136, cocking tab spring 138, fire control spring 140, transfer lever 142, and transfer lever spring 144 (referred to collectively as "fire control components"). The fire control components are installed within housing 132. As explained in more detail below in reference to FIGS. 6-9, transfer lever 142 transfers force from a firearm trigger to cocking block 134. Cocking block 134, in turn, applies an upward force to the rearward end of sear bar 110 causing the forward end of sear bar 110 to pivot downward and disengage sear 124 from striker 108, thereby, releasing striker 108 to discharge the firearm.

Cocking block 134 has a firing tab 146 extending from an upper surface. Firing tab 146 engages with the rearward end of sear bar 110. Cocking block 134 has a post 148 extending from both the right and left side. Posts 148 retain cocking block 134 in position within housing 132. Posts 148 are inserted within corresponding channels 156 in inner surfaces of housing 132. Posts 148 and channels 156 permit cocking block 134 to both pivot about an axis though the center of posts 148 and also to move longitudinally (fore and aft) along the channels 156.

Cocking block 134 has a slot 137 located rearward of posts 148. Slot 137 is configured to receive cocking tab 136. When installed in cocking block 134, cocking tab 136 extends out of an opening 139 at the top of cocking block 134. Cocking tab 136 is configured to slide in a relatively vertical direction within slot 137. Cocking tab spring 138 is disposed between the bottom of cocking tab 136 and a lower inside surface **137*a* of slot 137. Cocking tab spring 138** provides an upward force to cocking tab 136 biasing cocking tab 136 in an upward position.

Figure 14:
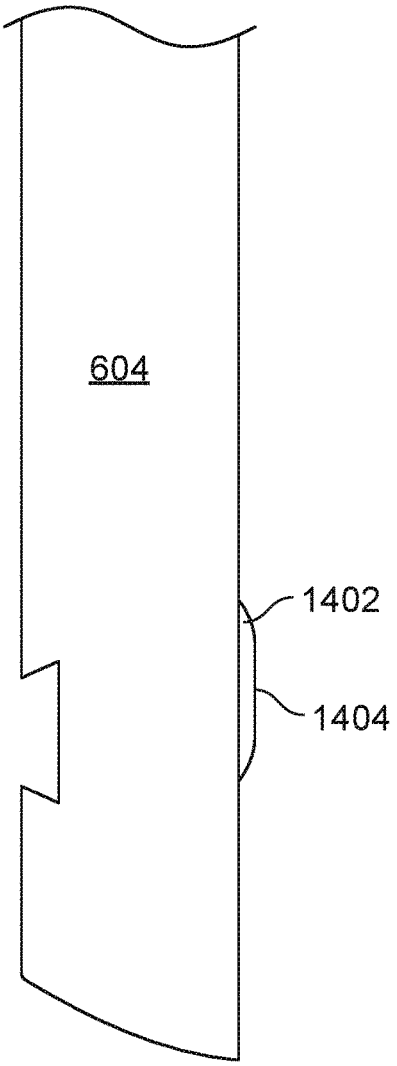
FIG. 14 is a diagram of a side view of an example firearm slide according to implementation of the present disclosure.
Figure 15:
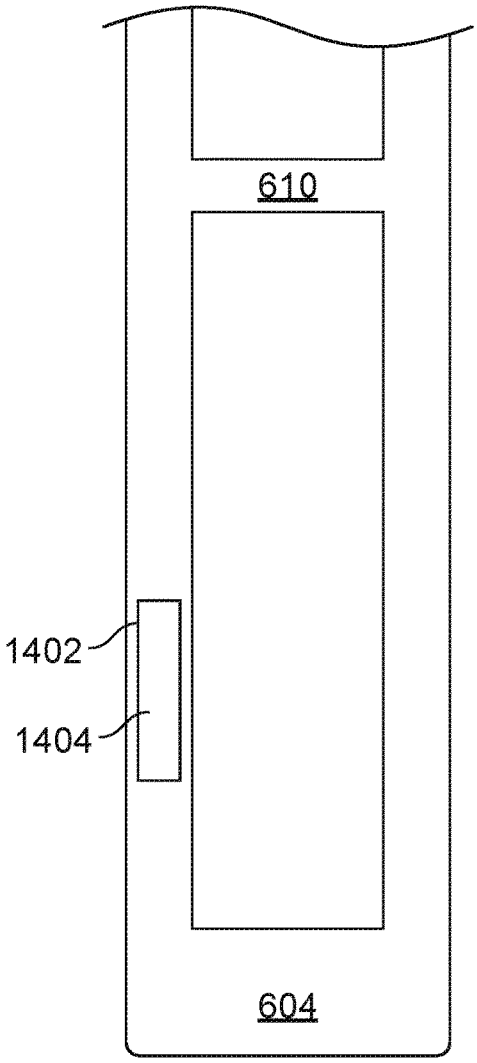
FIG. 15 is a diagram of a bottom view of an example firearm slide according to implementation of the present disclosure.

Cocking block 134 has a cam lug 158 forward of posts 148. Referring briefly to FIGS. 14 and 15, cam lug 158 engages with cam surface 1404 of a cam 1402 on the underside of a firearm slide 604. As described in more detail below, cam lug 158 and cam 1402 operate to cock the striker 108 when firearm slide 604 is operated either manually or by recoil.

One end of fire control spring 140 connects to a bottom side of cocking block 134, rearward of posts 148. The other end of fire control spring 140 connects to a spring connection slot 160 in the housing 132, thereby holding fire control spring 140 under tension. Fire control spring 140 exerts a force on cocking block 134 that tends to pivot the rearward end of cocking block 134 downwards and pull cocking block 134 longitudinally forward within channels 156.

Transfer lever 142 is pivotally coupled within housing 132. Transfer lever 142 has an upper end 150 that engages with the base 152 of cocking block 134. Upper end 150 of transfer lever 142 is shaped so as to apply an upward force to cocking block 134 when upper end 150 of transfer lever 142 is pivoted forward. Transfer lever 142 has a lower end 154, opposite the upper end 150. Lower end 154 has a trigger bar engagement surface 155 which engages with a trigger bar (shown in FIGS. 6-9 and described in more detail below). Transfer lever 142 can be pivotally coupled to housing 132 using a coupling device such as, e.g., a pin, roll pin, spring pin, screw, integrated coupling features similar to posts 148 on cocking block 134, or other appropriate coupling devices.

Transfer lever spring 144 is disposed between transfer lever 142 and an inner surface of housing 132. Transfer lever spring 144 applies a force to transfer lever 142 between pivot point 162 and the lower end 154 of transfer lever 142. This tends to cause the upper end 150 of transfer lever 142 to pivot in a rearward direction and the lower end 154 of transfer lever 142 to pivot in a forward direction, absent an external force applied through a trigger bar.

FIGS. 6-9 depict a series of internal diagrams of a firearm 600 illustrating the operation of the example striker firing system 100. Referring first to FIG. 6, the firearm 600 includes a frame 602, a slide 604, and a trigger 606. Striker assembly 102 is disposed within the slide 604 behind a breech wall 610. Striker assembly 102 is disposed within the slide 604 such that firing pin 120 on the end of striker 108 is aligned with a hole 612 through the breech wall 610.

Fire control assembly 104 is disposed within frame 602. Trigger 606 is coupled to a trigger bar 608 that engages with the trigger bar engagement surface 155 of transfer lever 142. Trigger bar 608 extends from trigger 606 around a magazine well 614 in frame 602 to engage trigger bar engagement surface 155 of transfer lever 142.

FIG. 6 illustrates the relative positions of striker assembly 102 components and fire control assembly 104 components within firearm 600 when firearm 600 is cocked with a cartridge 616 chamber. Striker 108 is cocked within striker housing 106. That is, striker 108 is in a fully rearward position within striker housing 106 with striker spring 112 compressed. Sear bar 110 is pivoted such that sear 124 is engage with sear engagement surface 122 to retain striker 108 in the cocked position. Fire control spring 140 pulls cocking block 134 into a forward position within channels 156 (see FIGS. 1-3) and pivots cocking block 134 such that firing tab 146 is in a lowered position below the rearward end of sear bar 110. Cam lug 158 of cocking block 134 rests against cam surface 1404 of cam 1402 positioning base 152 of cocking block 134 above upper end 150 of transfer lever 142. Transfer lever spring 144 biases transfer lever 142 in a position with upper end 150 in a rearward position and lower end 154 in a forward position. In some implementations, a safety mechanism 618 is located behind trigger 606.

Figure 7:
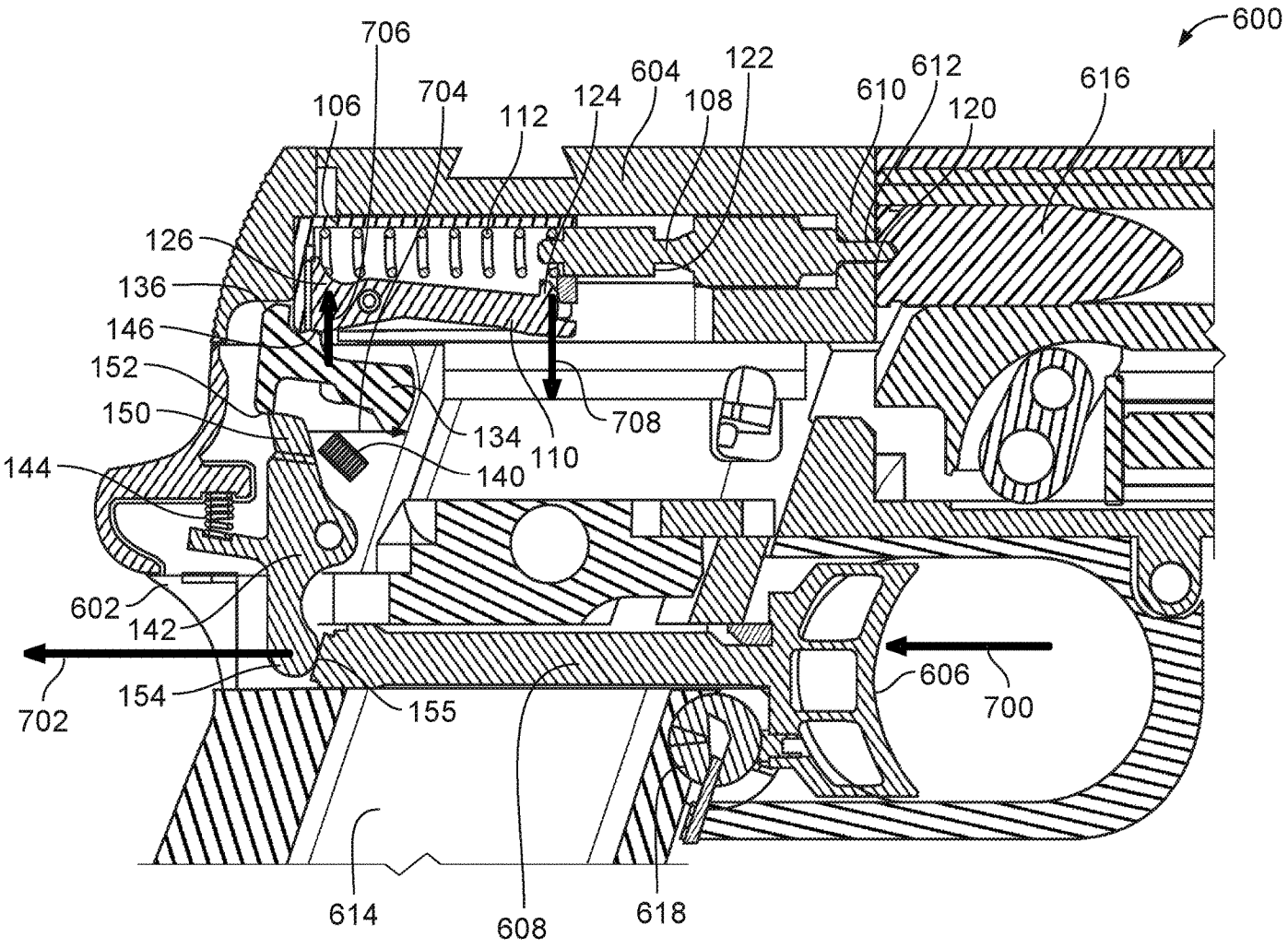

Referring next to FIG. 7, when a rearward force (arrow 700) is applied to trigger 606, trigger bar 608 transfers the force to lower end 154 of transfer lever 142, thus, causing transfer lever 142 to pivot against the force of transfer lever spring 144. Lower end 154 of transfer lever 142 pivots rearward (arrow 702) and upper end 150 of transfer lever 142 pivots forward (arrow 704). As upper end 150 of transfer lever 142 pivots forward, the shape of upper end 150 causes it to apply an upward force to the base 152 of cocking block 134. This causes cocking block 134 to pivot against the pull of fire control spring 140. As cocking block 134 pivots upward, cocking tab 136 is positioned behind striker housing 106 and firing tab 146 is pivoted upward (arrow 706). Firing tab 146 transfers the upward force to the rearward end of sear bar 110. Sear 124 pivots downward (arrow 708). Sear 124 disengages from sear engagement surface 122 releasing striker 108. Striker 108 is forced forward under pressure from striker spring 112. Firing pin 120 passes through hole 612 and impacts the primer on cartridge 616. As striker 108 is pushed forward by striker spring 112, reset spring 114 is compressed between breech wall 610 and front surface 130 of striker portion 118. Striker spring 112 has sufficient strength to overcome the force of reset spring 114 and impact a cartridge primer with sufficient force to discharge the cartridge.

Figure 8:
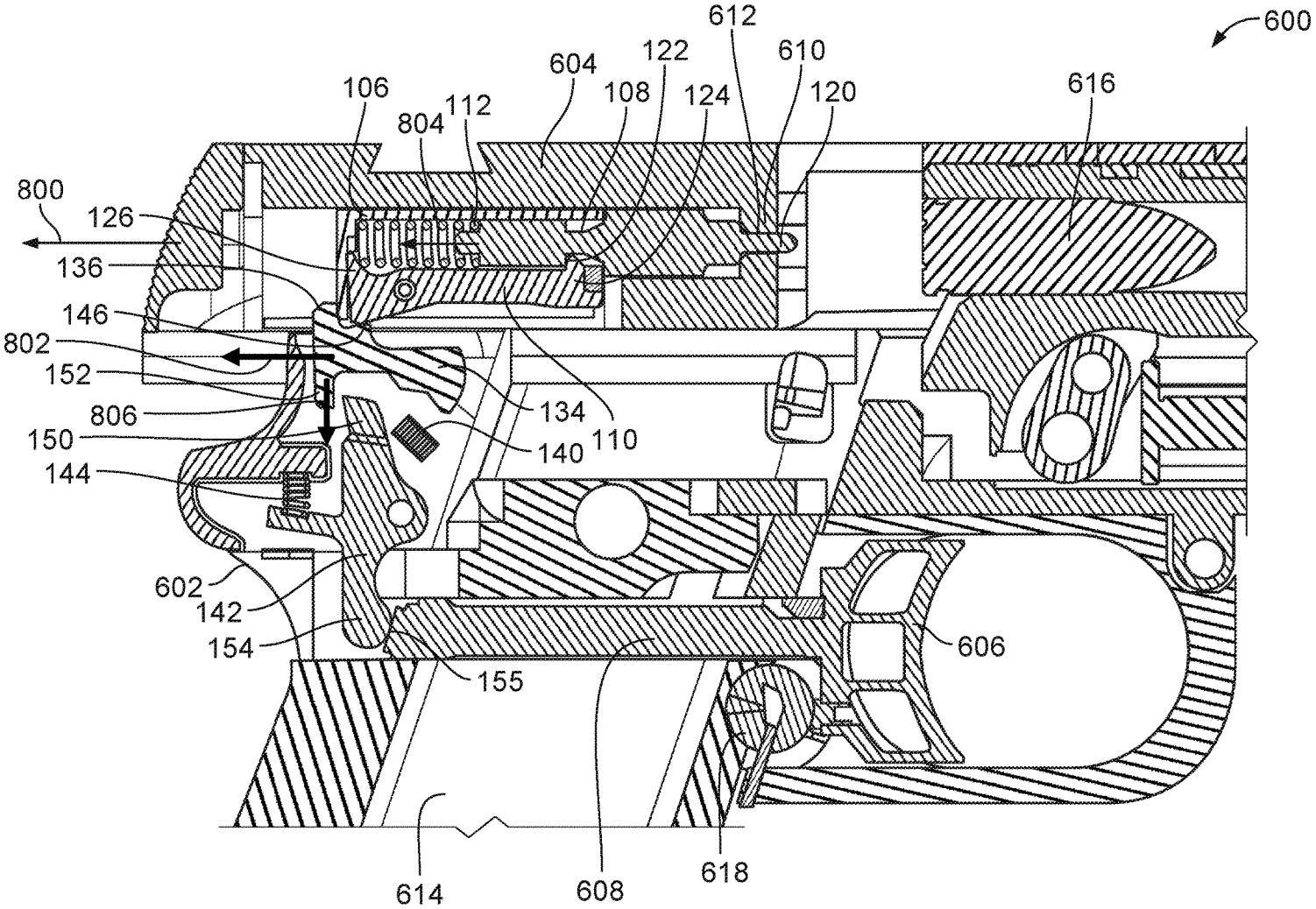

Referring next to FIG. 8, cartridge 616 is discharged creating a recoil force that pushes firearm slide 604 rearward (arrow 800). As slide 604 moves reward cocking tab 136 engages with an external rear surface of striker housing 106. The rearward motion of slide 604 pulls cocking block 134 rearward (arrow 802) within channels 156. When cocking block 134 reaches the rearmost position within channels 156, cocking tab 136 holds striker housing 106 stationary with respect to slide 604. Slide 604 continues to move rearward under the recoil force. The rearward motion of slide 604 relative to striker housing 106 pushes striker 108 back (arrow 804) into striker housing 106 and compresses striker spring 112. As cocking block 134 is moved rearward, it disengages from upper end 150 of transfer lever 142. Cocking block 134 is held in an upward position to keep cocking tab 136 engaged with striker housing 106 by cam lug 158 and slide cam 1402 (see FIGS. 3 and 10-14) until striker spring 112 is fully compressed. When cam lug 158 disengages from slide cam 1402, cocking block begins pivoting downward (arrow 806). The downward pivot of cocking block 134 permits sear 124 to reengage with sear engagement surface 122 of striker 108, thereby, recocking striker 108. Cocking tab 136 can be sized such that it remains engaged with striker housing 106 until sear 124 is fully engaged with striker 108.

Figure 9:
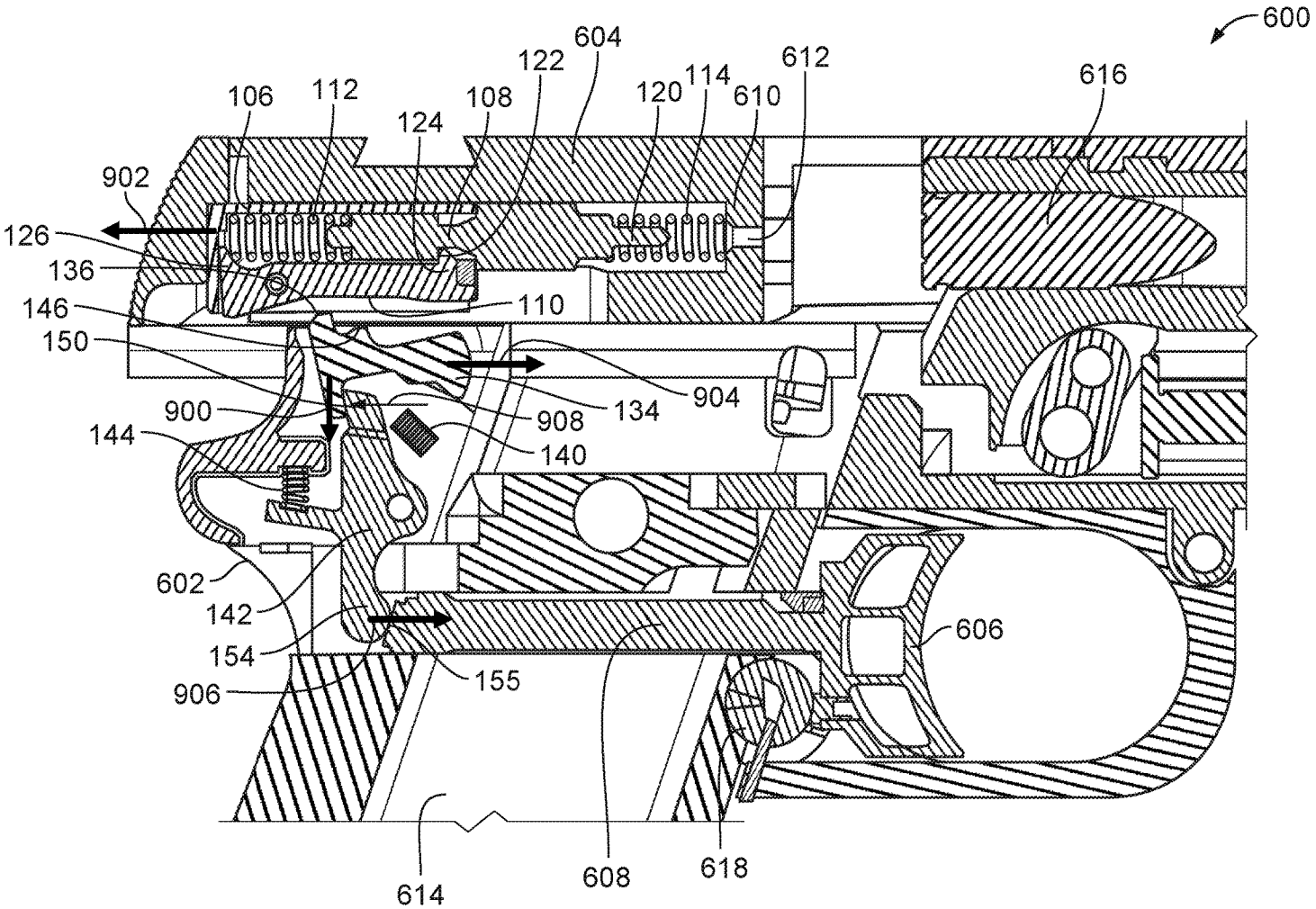

Referring next to FIG. 9, cocking block 134 pivots (arrow 900) into the fully downward position under the force of recoil, transmitted through striker assembly 102, and fire control spring 140. Cocking tab 136 disengages from striker housing 106. With striker 108 cocked inside striker housing 106, reset spring 114 pushes striker 108 and striker housing 106 rearward (arrow 902) within slide 604. In other words, reset spring 114 resets the position of striker assembly 102 back into the rearward portion of slide 604 after striker 108 is cocked. Once the recoil force from the discharge of cartridge 616 has dissipated, a recoil spring (not shown) of firearm 600 returns slide 604 back a forward position as shown in FIG. 6.

Referring still to FIG. 9, when cocking block 134 pivots into the downward position, the base 152 of cocking block 134 falls behind upper end 150 of transfer lever 142. In addition to causing cocking block 134 to pivot, fire control spring 140 also pulls cocking block 134 forward (arrow 904) within channels 156. Upper end 150 of transfer lever 142 is contained inside cut-out section 164 of cocking block 134 until a user releases trigger 606 allowing trigger 606 to reset. When the user releases trigger 606, transfer lever spring 144 resets trigger 606. Transfer lever spring 144 pivots lower end 154 of transfer lever forward (arrow 906) and upper end 150 rearward (arrow 908). As upper end 150 moves rearward, cocking block 134 moves rearward along channels 156 until upper end 150 can slide back underneath base 152 (as shown in FIG. 6). Once upper end 150 slides back underneath base 152, cocking block 134 is again returned to the forward position within channels 156 under the force of fire control spring 140.

In some implementations, sear bar 110 can be translationally coupled to striker housing 106. For example, sear bar 110 can be configured to move translationally along rails in the striker housing 106. For example, cocking block 134 can engage sear bar 110 to move sear bar 110 in a translational motion such that the sear 124 disengages from the sear engagement surface 122 of striker 108. In some implementations, sear bar 110 can be coupled to the slide of a firearm. In some implementations, the sear bar 110 can be coupled to a side or top of a striker assembly instead of the underside of a striker assembly.

In some implementations springs can be aligned with or coupled to components using pockets or holes in a component instead of posts or pins, as illustrated. For example, striker spring 112 can be aligned with striker 108 by a recess, pocket, or hole in the end of striker 108 instead of lug 117. Striker spring may rest within the recess, pocket or hole in the striker 108.

Figure 10:
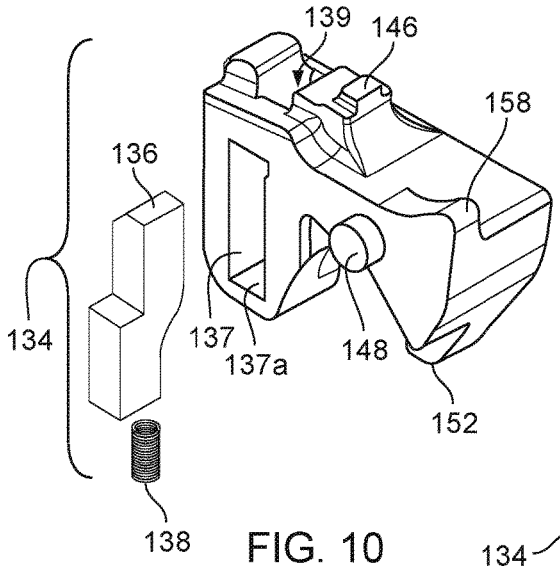
FIGS. 10 and 11 depict front and rear perspective views of an example cocking block according to implementations of the present disclosure.
Figure 11:
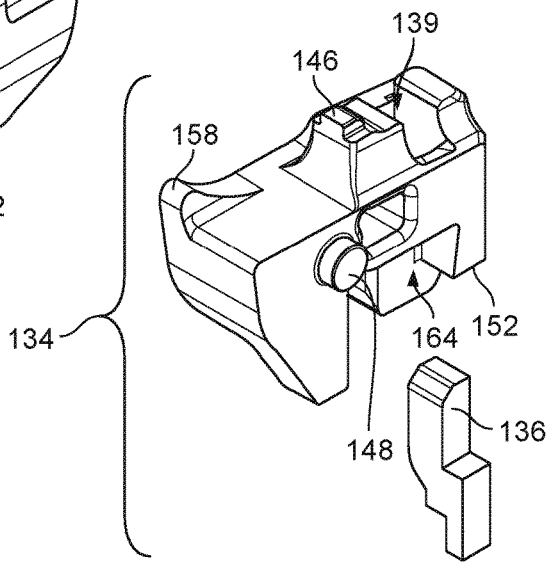
Figure 12:
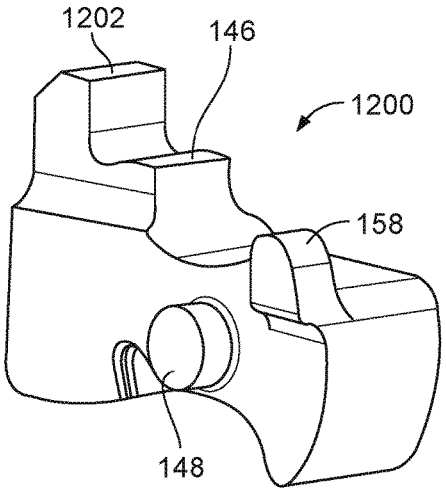
FIGS. 12 and 13 depict front and rear perspective views of another example cocking block according to implementations of the present disclosure.
Figure 13:
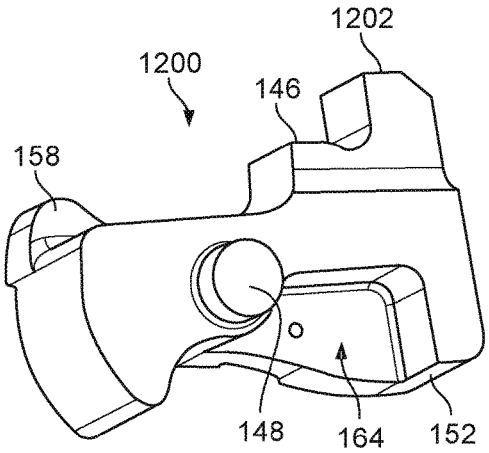

FIGS. 10 and 11 depict front and rear perspective views of one implementation of a cocking block 134 and FIGS. 12 and 13 depict front and rear perspective views of a second implementation of a cocking block 1200. Either of the illustrated cocking block design can be used in a striker firing system as described herein. Cocking block 134 represents a multi-part design and cocking block 1200 represents an integral design. Specifically, cocking block 134 has a movable cocking tab 136. When assembled, cocking tab 136 resides in slot 137. Cocking tab spring 138 is disposed between bottom surface 137*a* of slot 137 and cocking tab 136. Cocking tab spring 138 applies an upward force to cocking tab 136. The top of cocking tab 136 extends through opening 139. During operation, the moveable cocking tab 136 can be depressed during the cycling of a firearm slide 604. For example, once striker 108 is recocked and cocking block 134 is pivoted below striker housing 106 (as depicted in FIG. 9), cocking tab 136 may be pushed downwards against cocking tab spring 138. The design of cocking block 134 may, for example, permit striker housing 106 and slide 604 to slide over cocking tab 136 with less resistance. Cocking block 1200 has an integrated cocking tab 1202. Cocking block 1200 and cocking tab 1202 function similarly to cocking block 134, but represent a cocking block design with fewer moving parts which may be more easily manufactured.

FIG. 14 is a diagram of a side view of an example firearm slide 604 and FIG. 15 is a diagram of a bottom view of firearm slide 604. FIGS. 14 and 15 illustrate a cam 1402 on slide 604 that aids in the operation of cocking block 134 (or cocking block 1200) to cock striker 108 when slide 604 is manipulated (e.g., either manually or by recoil forces). Cam 1402 provides the mechanical timing to retain cocking block 134 pivoted in an upward direction to allow the rearward motion of slide 604 to cock striker 108 after cocking block 134 is pulled reward and disengaged from transfer lever 142. (as described in reference to FIGS. 6-9). The proper mechanical timing is provided by the length of cam 1402. Cam surface 1404 engages with cam lug 158 to retain cocking block 134 in the upward pivoted position until striker 108 is cocked and, once cocked, lug disengages with cam surface 1404 which permits cocking block 134 to pivot below striker housing 106 under the force of recoil, transmitted through striker assembly 102, and fire control spring 140 (as shown in FIG. 9). In some implementations, the slide cam 1402 can be configured to translate a cocking block 134 laterally instead of pivoting the cocking block 134 as illustrated.

Although the striker firing system has been described above in reference to an implementation for use in a semiautomatic handgun, in some implementations the striker firing system can be incorporated into or configured for use in other firearm designs. For example, the striker firing system can be configured for use in automatic, semiautomatic, or non-semiautomatic pistols and rifles. More specifically, for example, the striker assembly can be configured for use in a firearm bolt (e.g., a bolt for a lever action, pump action, or bolt action firearm). Additionally, a similar fire control assembly can be configured for use in a frame, receiver, or stock of a corresponding firearm (e.g., a rifle or shotgun).

A striker firing system for a firearm can be manufactured by providing a striker assembly 102 and a fire control assembly 104 as described herein. A striker spring 112 can be installed within a striker housing 106. A striker 108 can be installed within housing 106 and in contact with striker spring 112. A reset spring can be placed over a firing pin end of striker 108. A sear bar can be pivotally coupled to an underside of striker housing 106. The striker assembly 102 can be installed within a firearm slide 604. The fire control assembly 104 can be installed within a firearm frame 602. A transfer lever 142 can be pivotally coupled inside frame 602 with a transfer lever spring 144 disposed between transfer lever 142 and an inside surface of frame 602. A cocking block 134 (or cocking block 1200) can be installed within channels 156 in frame 602. One end of a fire control spring 140 can be connected to cocking block 134 and another end of fire control spring 140 can be connected to frame 602.

In some implementations, fire control assembly 104 can be installed within a fire control housing 132. Transfer lever 142 can be pivotally coupled inside housing 132 with a transfer lever spring 144 disposed between transfer lever 142 and an inside surface of housing 132. A cocking block 134 (or cocking block 1200) can be installed within channels 156 in housing 132. One end of a fire control spring 140 can be connected to cocking block 134 and another end of fire control spring 140 can be connected to housing 132. Housing 132 can be installed within a firearm frame 602.

While a number of examples have been described for illustration purposes, the foregoing description is not intended to limit the scope of the invention, which is defined by the scope of the appended claims. There are and will be other examples and modifications within the scope of the following claims.

What is claimed is:

1. A firearm firing system comprising:

a striker assembly comprising:

a striker housing, a striker disposed within the striker housing, and a sear bar coupled to the striker housing and positioned to engage a sear engagement surface of the striker through an opening in the striker housing; and a fire control assembly comprising:

a cocking block configured to engage with and pivot the sear bar, and a transfer lever configured to transfer force from a trigger to the cocking block.

2. The firing system of claim 1, wherein the striker housing is configured to be installed within a firearm slide.

3. The firing system of claim 1, wherein the fire control assembly is configured to be installed within a firearm frame.

4. The firing system of claim 1, wherein the sear bar comprises a sear at a first end of the sear bar, the sear being configured to engage the sear engagement surface of the striker, and wherein the cocking block engages the sear bar at a second end opposite the first end.

5. The firing system of claim 1, wherein the fire control assembly comprises a fire control housing with the cocking block and the transfer lever disposed therein.

6. The firing system of claim 5, wherein the cocking block comprises posts that engage with corresponding channels in inside surfaces of the fire control housing such that cocking block is free to pivot and slide fore and aft within the channels.

7. The firing system of claim 1, wherein the sear bar comprises a sear at a first end of the sear bar, the sear being configured to engage the sear engagement surface of the striker, wherein the cocking block engages the sear bar at a second end of the sear bar, opposite the first end, and wherein the transfer lever is configured to be pivotally coupled inside a firearm frame such that a force applied from a trigger of the firearm to a first end of the transfer lever causes the transfer lever to pivot such that a second, opposite end of the transfer lever engages the cocking block, thereby, pivoting the cocking block and causing the cocking block to pivot the second end of the sear bar upwards and the first end of the sear bar downwards to disengage the sear from the striker.

8. The firing system of claim 1, wherein the cocking block comprises a cocking tab that is configured to engage a back surface of the striker housing to retain the striker housing stationary during a rearward movement of a firearm slide, thereby, cocking the striker.

9. The firing system of claim 8, wherein the cocking tab is integral to the cocking block.

10. The firing system of claim 8, wherein the cocking tab is housed within a channel in the cocking block and configured to slide within the channel.

11. The firing system of claim 8, wherein the cocking block comprises a lug at an end of the cocking block opposite the cocking tab, the lug being configured to engage a cam surface of a firearm slide.

12. A firearm comprising:

a frame;

a slide installed on the frame;

a striker housing installed within the slide;

a striker disposed within the striker housing;

a sear bar coupled to the striker housing; and a fire control assembly installed within the frame, the fire control assembly comprising;

a cocking block configured to engage with and pivot the sear bar, and a transfer lever configured to transfer force from a trigger to the cocking block to pivot the sear bar and, thereby, disengage the sear bar from a sear engagement surface of the striker.

13. The firearm of claim 12, wherein the sear bar comprises a sear at a first end of the sear bar, the sear being configured to engage the sear engagement surface of the striker, wherein the cocking block engages the sear bar at a second end of the sear bar, opposite the first end, and wherein the transfer lever is pivotally coupled inside the frame such that a force applied from a trigger of the firearm to a first end of the transfer lever causes the transfer lever to pivot such that a second, opposite end of the transfer lever engages the cocking block, thereby, pivoting the cocking block and causing the cocking block to pivot the second end of the sear bar upwards and the first end of the sear bar downwards to disengage the sear from the striker.

14. The firearm of claim 12, wherein the fire control assembly comprises a fire control housing with the cocking block and the transfer lever disposed therein.

15. The firearm of claim 14, wherein the cocking block comprises posts that engage with corresponding channels in inside surfaces of the fire control housing such that cocking block is free to pivot and slide fore and aft within the channels.

16. The firearm of claim 12, wherein the cocking block comprises a cocking tab that is configured to engage a back surface of the striker housing to retain the striker housing stationary during a rearward movement of a firearm slide, thereby, cocking the striker.

17. The firearm of claim 16, wherein the cocking tab is integral to the cocking block.

18. The firearm of claim 16, wherein the cocking tab is housed within a channel in the cocking block and configured to slide within the channel.

19. The firearm of claim 16, wherein the cocking block comprises a lug at an end of the cocking block opposite the cocking tab, the lug being configured to engage a cam surface of a firearm slide.

20. The firearm of claim 12, wherein the sear bar is configured to engage the sear engagement surface of the striker through an opening in the striker housing.

* * * * *